US010570627B2

(12) United States Patent
Potter

(10) Patent No.: US 10,570,627 B2
(45) Date of Patent: Feb. 25, 2020

(54) DURABLE DECORATIVE PANELS

(71) Applicant: Groove Surfaces, LLC, Portsmouth, NH (US)

(72) Inventor: Bancroft S. Potter, Kittery, ME (US)

(73) Assignee: Groove Surfaces, LLC, Portsmouth, NH (US)

( * ) Notice: Subject to any disclaimer, the term of this patent is extended or adjusted under 35 U.S.C. 154(b) by 71 days.

(21) Appl. No.: 15/149,769

(22) Filed: May 9, 2016

(65) Prior Publication Data

US 2016/0368276 A1 Dec. 22, 2016

Related U.S. Application Data

(60) Provisional application No. 62/181,813, filed on Jun. 19, 2015.

(51) Int. Cl.
*E04F 15/10* (2006.01)
*B44C 5/04* (2006.01)

(52) U.S. Cl.
CPC ..... *E04F 15/107* (2013.01); *B44C 5/04* (2013.01)

(58) Field of Classification Search
None
See application file for complete search history.

(56) References Cited

U.S. PATENT DOCUMENTS

| | | | | |
|---|---|---|---|---|
| 4,068,861 | A * | 1/1978 | Zemke, Jr. | A63C 5/048 280/608 |
| 6,649,248 | B1 | 11/2003 | Schneider | |
| 6,818,282 | B2 | 11/2004 | Hynicka | |
| 8,297,018 | B2 | 10/2012 | Peng | |
| 2002/0100231 | A1* | 8/2002 | Miller | B32B 3/30 52/177 |
| 2004/0045240 | A1* | 3/2004 | McIlvaine | B32B 7/02 52/311.2 |
| 2005/0020762 | A1* | 1/2005 | Chou | B32B 27/08 524/502 |
| 2005/0170154 | A1 | 8/2005 | Breukers | |
| 2005/0249929 | A1 | 11/2005 | Reichwein | |
| 2007/0116933 | A1* | 5/2007 | Kobayashi | B44C 5/04 428/172 |
| 2009/0246466 | A1 | 10/2009 | Macedo | |
| 2014/0160535 | A1 | 6/2014 | Shen | |

FOREIGN PATENT DOCUMENTS

| | | | |
|---|---|---|---|
| WO | 2012175199 | 12/2012 | |
| WO | WO-2014114450 A2 * | 7/2014 | B32B 27/12 |

OTHER PUBLICATIONS

"PUR 717" (Kleiberit HotCoating® pdf; Web page < https://files.hoechsmann.com/lexikon/pdf/original/klb_hotcoating_en_2013.pdf?lang=en>, 4pgs., Mar. 2003) (Year: 2003).*

(Continued)

*Primary Examiner* — Laura C Powers
(74) *Attorney, Agent, or Firm* — Remenick PLLC

(57) ABSTRACT

A decorative and durable panel and a method of making the panel are disclosed. The panel comprises a substrate, an image affixed to the substrate, an abrasion resistant coating over the ornamental layer, and a clear hot melt upper layer.

15 Claims, 6 Drawing Sheets

(56) References Cited

OTHER PUBLICATIONS

"DPI and PPI Explained—Andrew Dacey Photography", Webpage <https://www.andrewdaceyphotography.com/articles/dpi/>, 3pgs., Feb. 9, 2014, retreived from Internet Archive Wayback Machine <<https://web.archive.org/web/20140209002502/https://www.andrewdaceyphotography.com/articles/dpi/>> on Dec. 13, 2017 (Year: 2014).*

Dots per inch, Wikipediat, <https://en.wikipedia.org/wiki/Dots_per_inch>.*

Pixels per inch, Wikipedia, <https://en.wikipedia.org/wiki/Pixel_density>.*

Machine Translation of WO 2014/114450 (Year: 2014).*

PCT Search Report and Written Opinion for PCT/US2016/38011 dated Sep. 13, 2016.

* cited by examiner

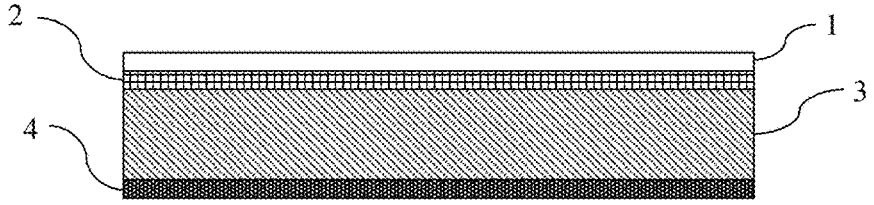
FIGURE 1 – PRIOR ART
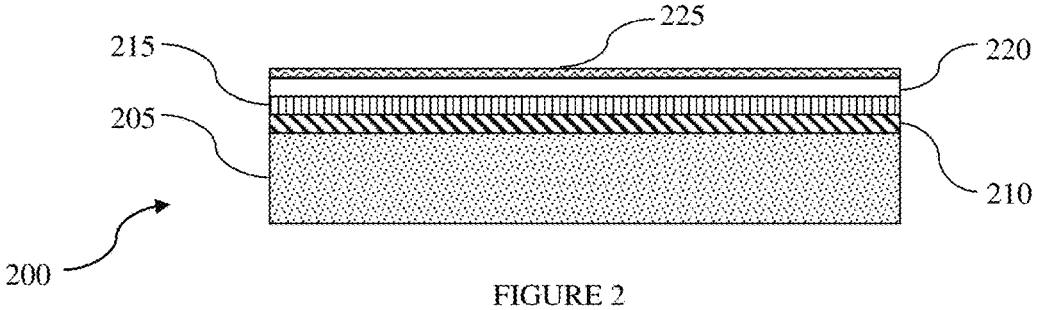
FIGURE 2
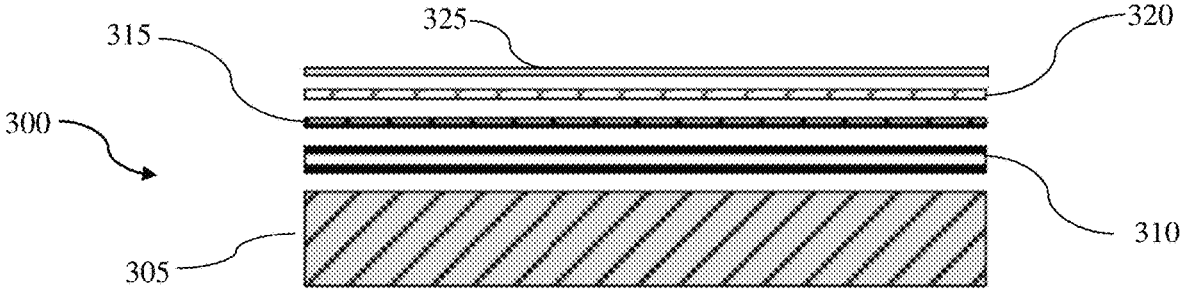
FIGURE 3

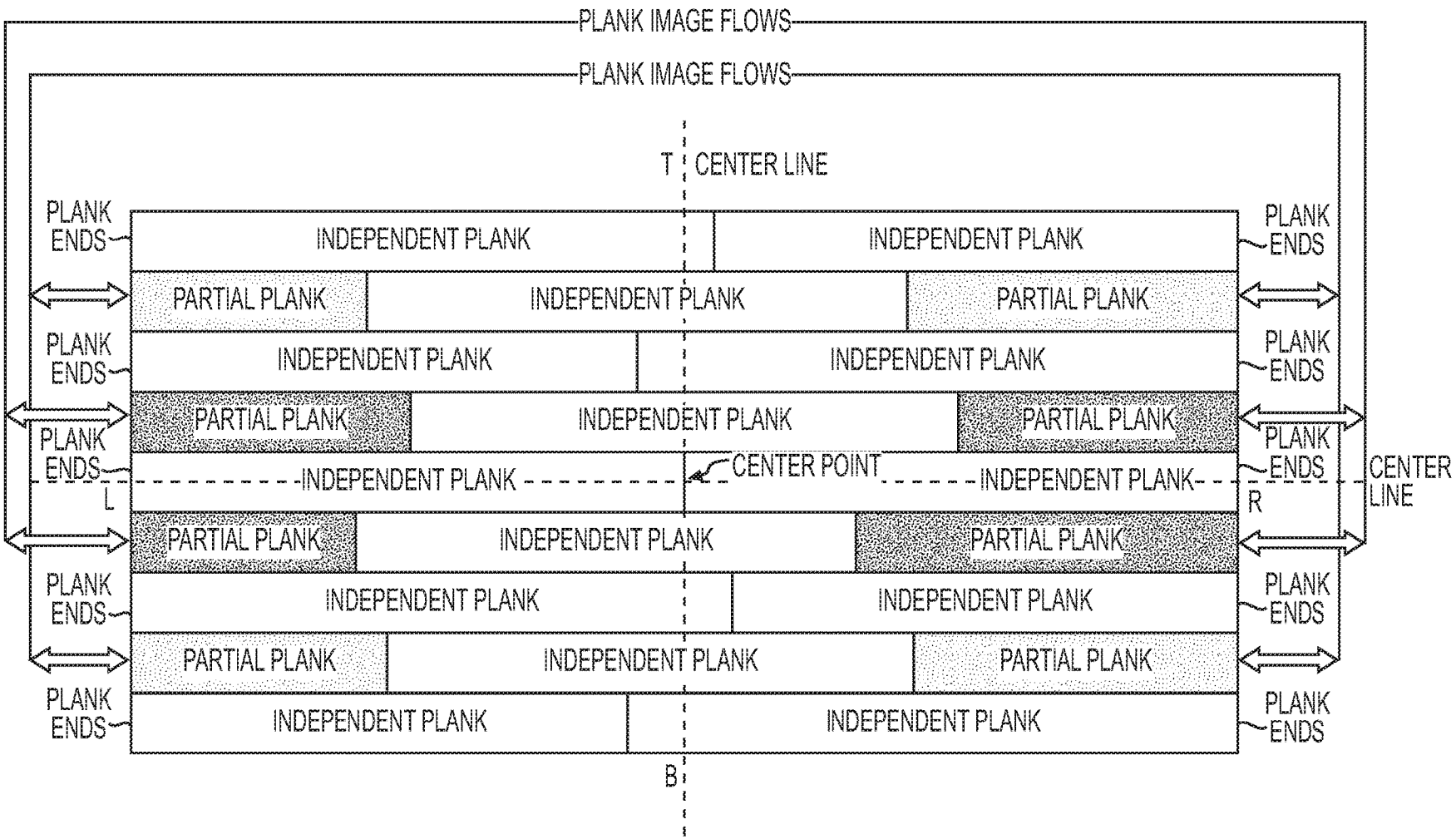
PLANK IMAGE FLOWS
PLANK IMAGE FLOWS
CENTER LINE
T
CENTER LINE
PLANK ENDS
PLANK ENDS
PLANK ENDS
PLANK ENDS
PLANK ENDS
PLANK ENDS
PLANK ENDS
PLANK ENDS
R
L
B
CENTER POINT
INDEPENDENT PLANK
PARTIAL PLANK
INDEPENDENT PLANK
PARTIAL PLANK
INDEPENDENT PLANK
PARTIAL PLANK

DURABLE DECORATIVE PANELS

REFERENCE TO RELATED APPLICATIONS

This application claims priority to U.S. Provisional Application No. 62/181,813, entitled "Durable Decorative Panels," which was filed Jun. 19, 2105 and which is specifically and entirely incorporated by reference.

BACKGROUND

1. Field of the Invention

The invention is directed to decorative panels. More particularly, the invention is directed to abrasion resistant, durable decorative panels.

2. Background of the Invention

Many industries use paneling that must be able to endure high levels of wear and tear. For example, boats usually have paneling that is adapted for use in wet environments and corrosive conditions, like salt water, sand, wind and rain Likewise, recreational vehicles have panels that that are subjected to the elements as well as harsh road conditions. Many commercial kitchens and bathrooms use panels that can be hosed down for easy cleaning and disinfecting. However, typically these panels are undecorated or monochromatic.

Traditionally, there are two main options for options for temporary flooring solutions. Temporary flooring may be used for events such as concerts, weddings, parties, rallies, fairs, shows, stage flooring, and other happenings. Temporary flooring can be used indoors or outdoors and may cover many types of ground, including grass, dirt, sand, carpet, concrete, wood, tile, asphalt, and other substrates.

Typically, especially in situations where the ground is uneven, a layer of plywood or other subflooring is laid to level the surface. Then on top of the subflooring, traditional permanent flooring is laid. For example, the top layer can be carpet, natural or artificial wood planks, tile, or another surface. This method of installing a temporary flooring is tedious and often damages the components used in the top layer as they are laid, picked up, and replaced since the permanent flooring components are not intended for such repeated use.

The artificial wood planks used are usually laminate flooring. As depicted in FIG. 1, laminate flooring is a layered panel that usually includes a wear resistant upper layer 1, a design layer 2, a core layer 3, and a backing layer 4. Upper layer 1 is usually a transparent, stain resistant surface. Design layer 2 is usually an image applied to a paper product and can be in many patterns. For example, the patterns can be wood grain, stone, metal, other natural looking images, or non-natural images. Often, the design layer is made from thin rolls of paper printed with an image and then cut and laminated to the core layer. Core layer 3 is typically a fiberboard that provides impact resistance and stability. Backing layer 4 is usually a melamine layer that provides stability and moisture resistance.

A quicker, more durable solution for temporary flooring is interconnecting tiles. The tiles are typically made of plastic, rubber, or another long lasting, durable, and light weight material. However, the interconnecting tiles are typically unadorned with each tile being a single color. The flooring provides an industrial, unsophisticated appearance.

Therefore, there is a need for an easily installable, durable, panels that provide a sophisticated appearance.

SUMMARY OF THE INVENTION

The present invention overcomes the problems and disadvantages associated with current strategies and designs and provides new tools and methods of providing decorative panels.

An embodiment of the invention is directed to a panel. The panel comprises a substrate, an image affixed to the substrate, an abrasion resistant hot melt coating the substrate and image, and a clear upper layer.

In a preferred embodiment, the panel further comprises a base layer affixed to the substrate, wherein the base layer is chosen from the group comprising fiberboard, particle board, cardboard, layers of paper, plastic, rubber, composite materials, fiberglass, sheet rock, honeycomb, nylon, wax or plastic impregnated materials, fused layers of materials, concrete, stone, metal, melamine, oriented strand board, and combinations thereof. Preferably, the substrate is comprised of one of at least one of fiberglass reinforced plastic (FRP), polyvinyl chloride (PVC), high pressure laminate (HPL), medium density fiberboard (MDF), film, melamine, sheetrock, composite materials, orientated polypropylene (OPP), non-woven materials paper, cardboard, wood, metal, plastic, cellulous, fabric, or combinations thereof.

The image is preferably affixed to substrate by at least one of an ink jet printer, a laser printer, a solid ink printer, a dot matrix printer, a dye-sublimation printer, a thermal printer, a line printer, a gravure printer, and a plotter, and the image has a resolution of at least 250 pixels per inch. Preferably, the image is chosen from the group comprising wood patterns, stone patterns, tile patterns, brick patterns, solid colors, natural patterns, unnatural patterns, pictures, or combinations thereof. In a preferred embodiment, there are a plurality of panels and the pattern from a first panel continues onto a second panel. Preferably, the panel at least one of resists dents, abrasion, ultra violet light, scratches and water damage, and is anti-slip.

In a preferred embodiment, multiple panels are arranged to provide a temporary flooring. Preferably, the panel can be installed without a base layer. Preferably, the panel further comprises texture applied to the panel. In a preferred embodiment, the panel is one of a horizontal or vertical surface. The hot melt is preferably a moisture curing hot melt and the top coat is preferably a UV (ultraviolet) curing top coat. Preferably, the image is adapted to continue, uninterrupted, from one panel to another panel.

Another embodiment of the invention is directed to a method of making a panel. The method comprises the steps of obtaining an image for the panel, processing the image, printing the processed image on a substrate, coating the substrate and image with an abrasion resistant hot melt coating, and applying a clear coat upper layer to the panel.

The method preferably further comprises affixing a base layer to the substrate, wherein the base layer is chosen from the group comprising fiberboard, particle board, cardboard, layers of paper, plastic, rubber, composite materials, fiberglass, sheet rock, honeycomb, nylon, wax or plastic impregnated materials, fused layers of materials, concrete, stone, metal, melamine, oriented strand board, and combinations thereof. Preferably, the substrate is comprised of one of at least one of fiberglass reinforced plastic (FRP), polyvinyl chloride (PVC), high pressure laminate (HPL), medium density fiberboard (MDF), film, melamine, sheetrock, composite materials, orientated polypropylene (OPP), non-woven materials paper, cardboard, wood, metal, plastic, cellulous, fabric, or combinations thereof.

In a preferred embodiment, the image is affixed to the substrate by at least one of an ink jet printer, a laser printer, a solid ink printer, a dot matrix printer, a dye-sublimation printer, a thermal printer, a line printer, a gravure printer, and a plotter, and has a resolution of at least 250 pixels per inch. Preferably, the image is chosen from the group comprising wood patterns, stone patterns, tile patterns, brick patterns, solid colors, natural patterns, unnatural patterns, pictures, or combinations thereof. In a preferred embodiment, the image is obtained by a scanner having an image resolution of at least 20 megapixels. The processing of the image preferably comprises editing the image so that a pattern from a first panel continues onto a second panel.

In a preferred embodiment, the panel at least one of resists dents, abrasion, ultra violet light, scratches and water damage, and is anti-slip. The method preferably further comprises the step of arranging multiple panels to provide a temporary flooring. Preferably, the panel can be installed without a base layer. The method preferably further comprises the step of applying a texture to the panel. Preferably, the panel is one of a horizontal or vertical surface. In a preferred embodiment, the printing and coating steps occur in a continuous roll to roll process. The hot melt is preferably cured with moisture and the top coat is preferably cured with UV (ultraviolet) light. Preferably, the image is adapted to continue, uninterrupted, from one panel to another panel.

Other embodiments and advantages of the invention are set forth in part in the description, which follows, and in part, may be obvious from this description, or may be learned from the practice of the invention.

DESCRIPTION OF THE DRAWING

The invention is described in greater detail by way of example only and with reference to the attached drawing, in which:

FIG. 1 depicts the layers of existing laminate flooring.

FIG. 2 depicts an embodiment of the layers of the inventive panel.

FIG. 3 depicts another embodiment of the layers of the inventive panel.

FIGS. 7A-B depict an embodiment of a plank layout that can be installed in any orientation and have a continuous image from one plank to the next.

DESCRIPTION OF THE INVENTION

Figure 4:
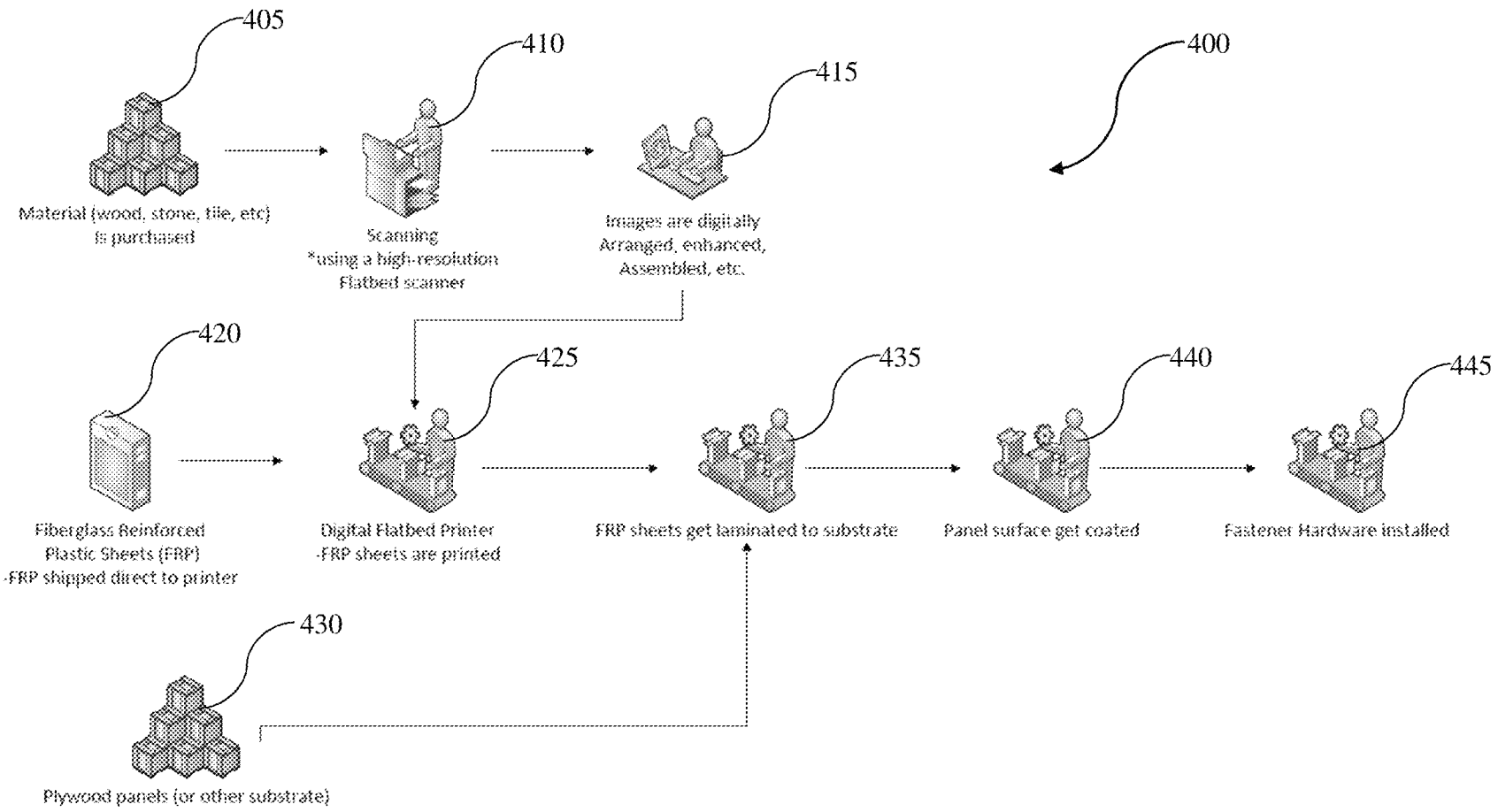
FIG. 4 depicts a flowchart of an embodiment of the method of manufacturing the inventive panels.

As embodied and broadly described herein, the disclosures herein provide detailed embodiments of the invention. However, the disclosed embodiments are merely exemplary of the invention that may be embodied in various and alternative forms. Therefore, there is no intent that specific structural and functional details should be limiting, but rather the intention is that they provide a basis for the claims and as a representative basis for teaching one skilled in the art to variously employ the present invention A problem in the art capable of being solved by the embodiments of the present invention is long lasting and durable horizontal and vertical surface paneling. It has been surprisingly discovered that large, decorative panels can be constructed using large scale printing and coating techniques. The panels can be used for temporary or permanent horizontal and vertical surfaces. For example, the panels can be wall panels, ceiling panels, kitchen backsplashes, countertops, veneers for various permanent and movable furniture or fixtures, and flooring. Preferably, the panels can be used in recreational vehicles, boats, planes, cars, trucks, other vehicles, and permanent or temporary buildings. The panels can be quickly and easily assembled and taken apart, for example as temporary flooring, without the need for a subfloor or other separate base layer. FIG. 2 depicts an embodiment of the layered panel 200 of the instant invention. Preferably, panel 200 is a 4 foot by 8 foot rectangle, however panel 200 can have another size or shape. For example, panel 200 can be 2 feet by 4 feet, 1 foot by 2 feet, 4 feet by 4 feet, 6 feet by 6 feet, another length to width ratio, circular, ovular, triangular, and/or a custom size and/or shape. In other embodiments, a roll of material can be produced and later cut to appropriate sizes in a roll to roll printing operation. Preferably, panel 200 is able to be resized or reshaped as necessary to fit a desired layout. Preferably, panel 200 is under 60 lbs., under 30 lbs., or under 15 lbs. Preferably, panel 200 is able to be lifted and maneuvered by one or two people. Preferably, panel 200 is less than two inches thick, less than an inch thick, or less than half an inch thick.

Panel 200 is preferably comprised of several layers. Base layer 205 is preferably plywood and provides stability and durability to the floor panel 200. Base layer 205 can also be made of fiberboard, particle board, cardboard, layers of paper, plastic, rubber, composite materials, fiberglass, sheet rock, honeycomb, nylon, wax or plastic impregnated materials, fused layers of materials, concrete, stone, metal, melamine, oriented strand board, other manmade or naturally occurring materials, or combinations thereof. Preferably, base layer 205 is optional depending on the intended use of the panels and the location of installation.

Atop of base layer 205 is preferably substrate 210. In a preferred embodiment, substrate 210 is a thin sheet of fiberglass reinforced plastic (FRP) with a printed image 215 on one side. Preferably, substrate 210 is less than 10 mm thick, less than 5 mm thick, or less that 2 mm thick. In other embodiments, substrate 210 can be made of PVC (polyvinyl chloride), HPL (high pressure laminate), MDF (medium density fiberboard), film, melamine, sheetrock, composite materials, OPP (orientated polypropylene), non-woven materials paper, cardboard, wood, metal, plastic, cellulous, fabric, or another material or combinations thereof. Preferably, substrate 210 is waterproof and damage resistant. Any image 215 can be printed on substrate 210, including but not limited to, wood patterns, stone patterns, tile patterns, brick patterns, solid colors, other natural patterns, other unnatural patterns, pictures, or combinations thereof. Preferably, the image 215 is printed on substrate 210 using direct print or dye sublimation. For example, an ink jet printer, a laser printer, a solid ink printer, a dot matrix printer, a dye-sublimation printer, a thermal printer, a line printer, a gravure printer, a plotter, or another printing device. However, the image can be hand drawn, etched, a lithograph, or made with another technique. In another embodiment, the image 215 is printed on a roll of substrate material, for example in a roll to roll printing device, and then adhered to another substrate. Preferably, the image is printed in a high resolution, for example the resolution can be above 250 pixels per inch (PPI), above 500 PPI, above 800 PPI, or above 1000 PPI. Substrate 210 is preferably affixed to base layer 205 with an adhesive. The adhesive can be a lamination, a glue, an epoxy, or another substance. In other embodiments, substrate 210 is affixed to base layer 205 with nails, staples, screws, tacks, or other fastening devices.

On top of the substrate 210 is preferably an abrasion resistant coating 220. Preferably, coating 220 resists dents and other damage, is waterproof or water resistant, is UV (ultra violet light) resistant, scratch resistant, or anti-slip. Coating 220 may have grooves or other patterns embedded therein. For example, groves may be embedded into coating 220 to mimic wood grain or stone textures. Preferably, the grooves compliment the image 215 of ornamental layer 210. Preferably, abrasion resistant coating 220 is a hot melt plastic coating. For example, coating 220 can be KLEIBERIT® hot melt or another coating capable of abrasion resistance. Preferably, abrasion resistant coating 220 is a moisture curing hot melt or a UV curing hot melt. Preferably, coating 220 has a Taber test rating of above 5,000, above 8,000, or above 10,000. Preferably, the uppermost layer of panel 200 is a clear coat 225. Preferably, clear coat 225 adds another protective later to panel 200. Preferably, clear coat 225 is a UV curing coating. Panel 200 may additionally have other layers including, but not limited to, cushioning, waterproofing, anti-skid, noise dampening, and in-floor heating or cooling. Additionally, the floor panel 200 may be wired for electricity, wired for Ethernet, wired for sound systems, have HVAC ducts, have built-in lighting, and/or have plumbing.

Preferably, multiple panels 200 are placed side by side during installation. Preferably, the panels 200 can be placed on a surface without the need for a subfloor or base layer. Abutting panels 200 may be connected with screws, nails, clips, adhesives, or other fasteners. Abutting panels 200 may also merely be placed next to each other or may be coupled with various joints. Preferably, end panels may be positioned at the edges of the installation to provide a finished and permanent appearance.

FIG. 3 depicts another embodiment of the layers of a panel 300. The materials of panel 300 are similar to those of panel 200, with the following layers: The upper surface of panel 300 is preferably a protective clear coat 325. Clear coat 325 preferably provides a surface sheen to hot melt coating 320. Coating 320 preferably provides an abrasion and water resistant coating to printed high resolution image 315. Preferably, image 315 is printed onto FRP sheet 310. Optionally, FRP sheet 310 may be affixed to a base layer 305.

FIG. 4 depicts an embodiment of a method 400 of creating panels 200. A design for the panel is chosen at step 405. The design may be to mimic natural or manmade products, may be abstract, a solid color, a photograph, or another image. At step 410, a digital image of the design is preferably obtained or created. Preferably the image is a high resolution image, for example the resolution of the image can be above 10 megapixels, above 30 megapixels, above 60 megapixels, above 100 megapixels, or higher. The digital image may be obtained using a scanner (for example, a high resolution flatbed scanner), a digital camera, computer designed, or with another imaging device. In other embodiments, the image may be digitally created using various computer software programs. The image is preferably arranged, enhanced, and finalize at step 415. For example, the brightness, contrast, size, shape, aspect ratio, hue, and positioning may be altered. Additionally, photo-editing software can be used to arrange the images in a manner wherein the design of the panels is continuous from one panel to the next. For example, in the case of wood planks, the planks which end at the edge of one panel preferably continue onto the next panel. The planks are cropped and arranged so that the same plank appears to be continuing onto the next panel. The wood grain is then continuous. The eye follows the plank from one panel to the next to assist in giving the overall floor a real "planked," seamless look, instead of a number of panels being tiled out.

Figure 5A:
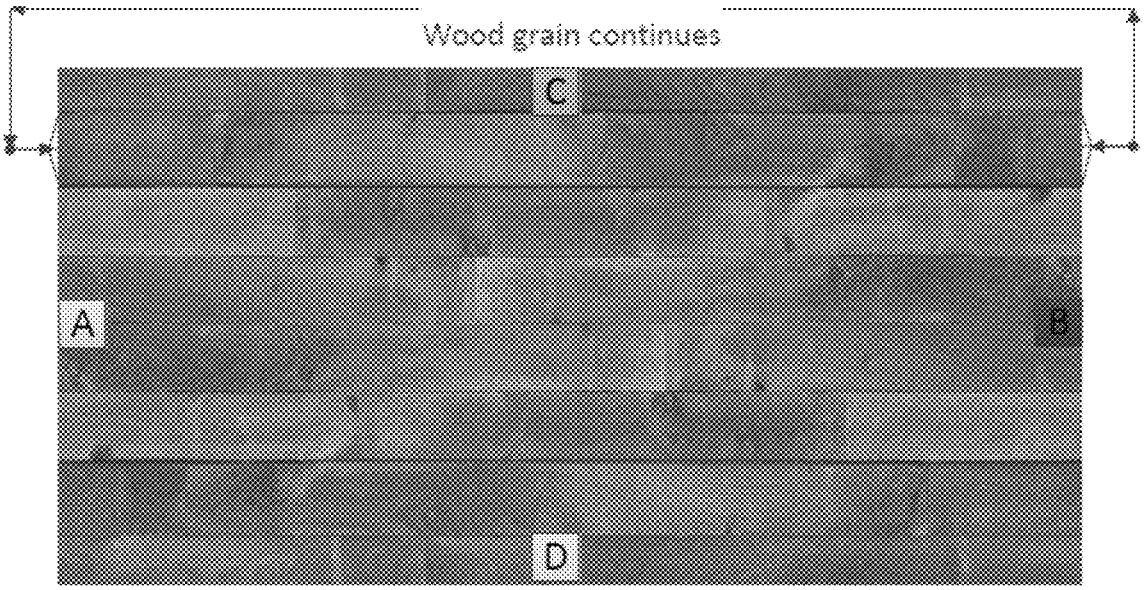
FIGS. 5A-B depicts an embodiment of an image continuing over several panels.
Figure 5B:
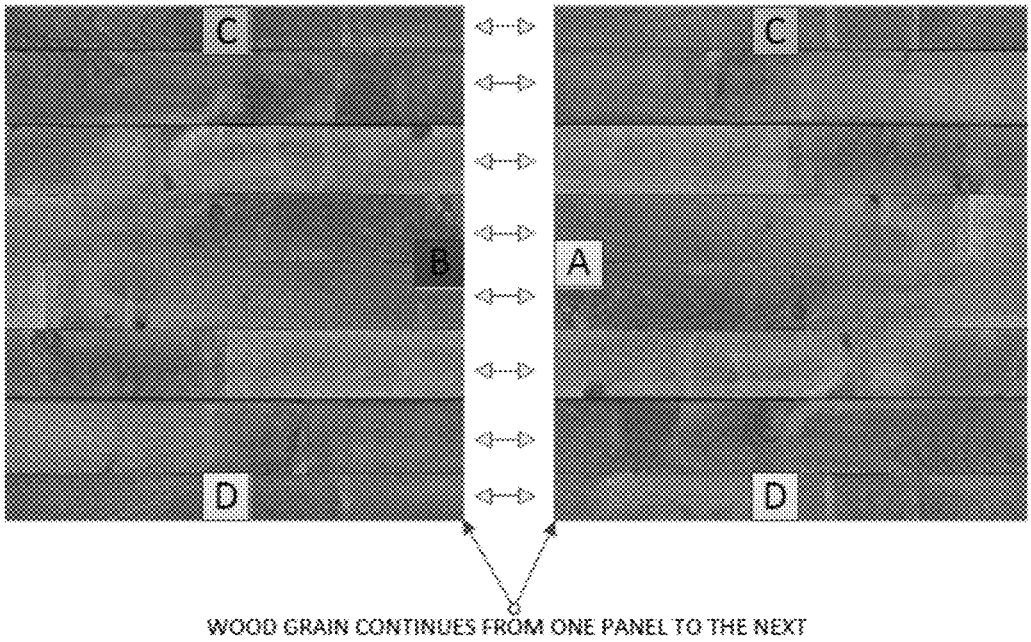
Figure 6:
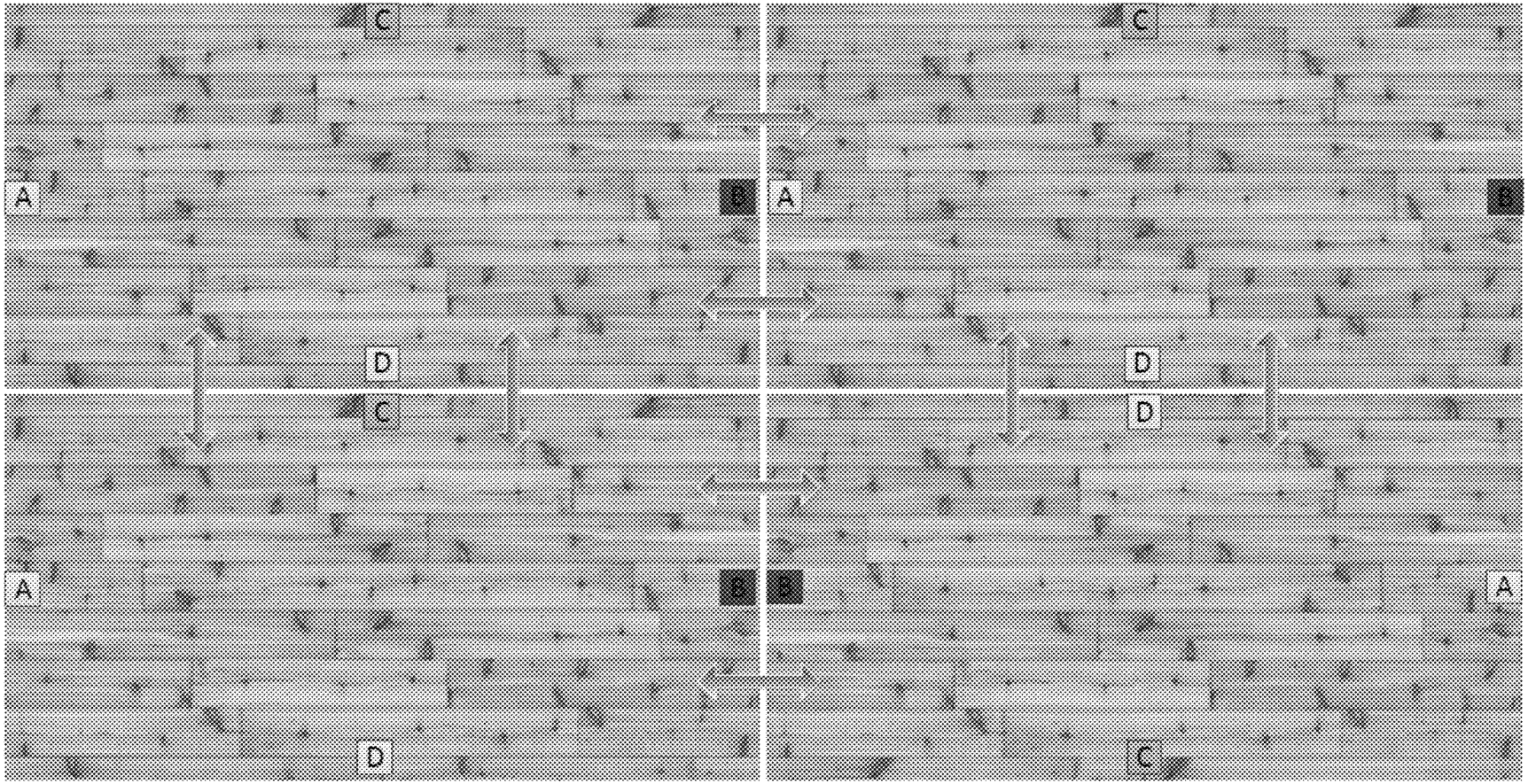
FIG. 6 depicts an another embodiment of an image continuing over several panels.

FIGS. 5A-B and 6 depict two embodiments of the image continuing from one panel to the next. FIG. 5A depicts a full panel and FIG. 5B depicts two adjacent panels. As can be seen in FIGS. 5A, the image of the wood grain pattern continues to edges A and B such that when side A is abutted with side B, as shown in FIG. 5B, the wood grain pattern continues from one panel to the next without interrupting the pattern. Thus, when installed, the material gives the appearance that it is one continuous image or installation. Furthermore, as shown in FIG. 6, the image may be arranged such that the image appears to continue from one panel to the next regardless of the orientation of the panel. As can be seen in FIG. 6, the image continues from edge B of one panel to edge A of the next panel and from edge B of one panel to edge B of the next panel. While not shown it is apparent that the image would also continue from edge A of one panel to edge A of the next panel Likewise, the image continues from edge D of one panel to edge C of the next panel and from edge D of one panel to edge D of the next panel. While not shown it is apparent that the image would also continue from edge C of one panel to edge C of the next panel. With such an arrangement, the panel has no "top" or "bottom." The panel can be installed in a rotated orientation and the material will maintain the continuous flow from one panel to the next. Additionally, the panels can be installed stacked one on top of the next so that the material along the edges gives the appearance that it is continuous from one panel to the next.

Figure 7B:
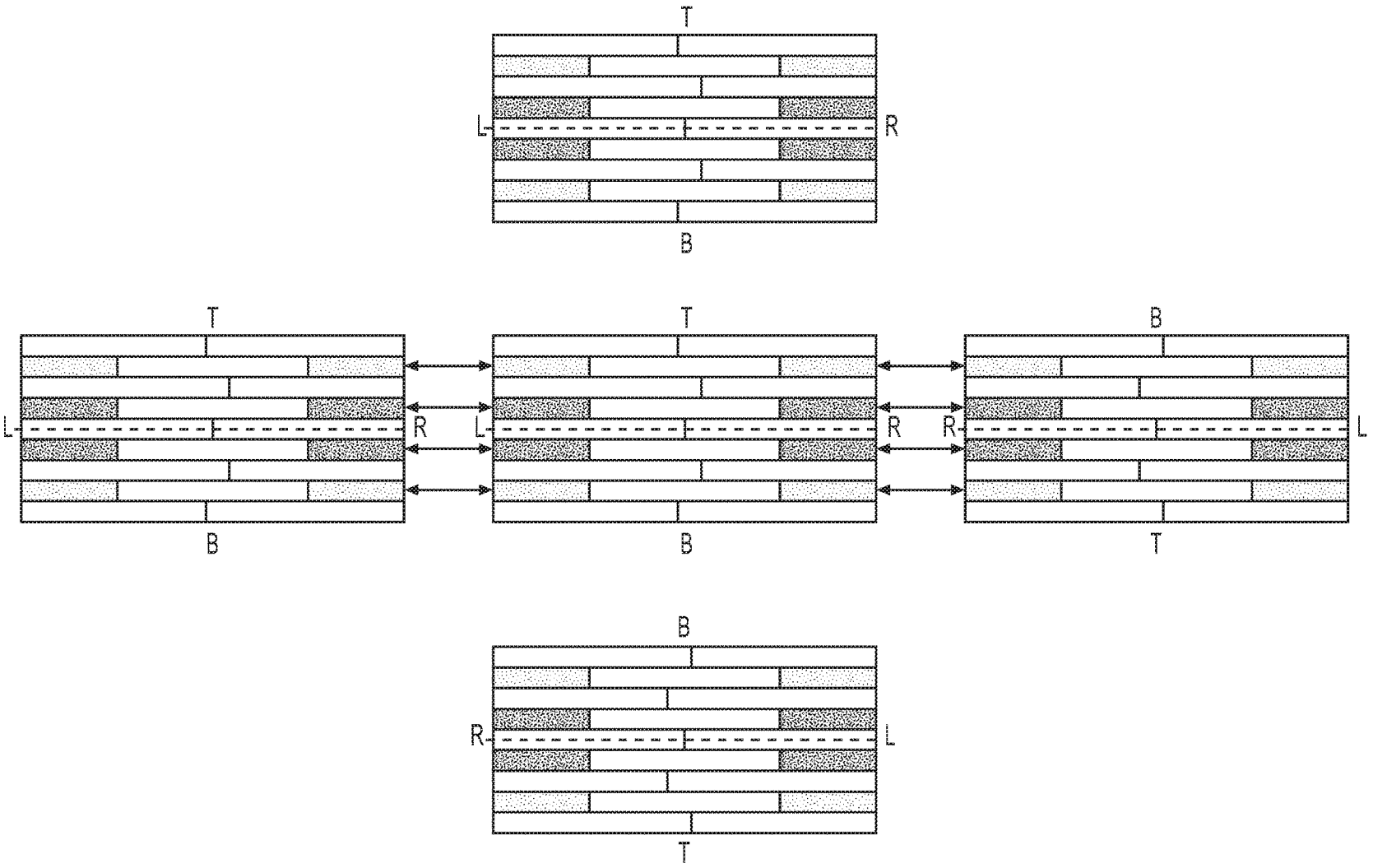

FIGS. 7A and B depict another embodiment of an image of wood grain planks position on a panel such that the image gives the illusion of a continuous flow from panel to panel, regardless of the panels' orientations. As can be seen in FIG. 7A, starting from the top of the panel (labeled "T"), the first row has two full or independent planks. The second row has a full or independent plank in the center with two partial planks on either side. The pattern continues with odd rows having two full planks and even rows having a full center plank and two partial side planks. As can be seen in FIG. 7B, regardless of orientation, the panels preferably line up horizontally such that the partial planks of one panel abut partial planks of an adjoining panel and full planks of one panel abut full planks of an adjoining panel. Additionally, the planks line up vertically such that the top of one panel and the bottom of the adjoining panel continue the plank image. Furthermore, the bottom of one panel and the bottom of an adjoining panel if one panel was rotated or the top of one panel and the top of an adjoining panel if one panel was rotated also continue the plank image. With such a layout on each panel, panels can be laid without concern for the orientation of each panel as it is placed. Note, top, bottom, left, and right as used herein refer to the corresponding portions of the figure and are used merely for convenience to indicate the relative positions of the panel depicted in FIG. 7A as oriented on the page. While the figures show specific measurements these are merely one embodiment and other measurements, number of rows, planks per row, and layouts can be used.

Returning to FIG. 4, at step 420, the substrate material is chosen and at step 425, the image is applied to the substrate. Step 425 may be accomplished with an ink jet printer, a laser printer, a solid ink printer, a dot matrix printer, a dye-sublimation printer, a thermal printer, a line printer, a plotter, or another printing device. At step 430, the base layer is chosen. The substrate is affixed to the base layer at step 435. Step 435 can be accomplished with an adhesive, a glue, an epoxy, another substance, nails, staples, screws, tacks, or other fastening devices. At step 440 the substrate is coated with an abrasion resistant coating and a clear coat. Additionally, the panel may be given a texture at this point. For example, the texture may be applied with a mold, by etching, by scraping, or by another technique. At step 445, fasteners for coupling multiple panels together are applied to each panel. Preferably, the fasteners allow for the panels to be assembled into a temporary, re-locatable floor, wall, or other installation that can be laid, taken up, and reinstalled multiple times in multiple locations. Preferably, the original parts are reused in each installation and the panels remain undamaged during disassembly.

In another embodiment, in a continuous roll to roll process, the ornamental layer is printed with the image then, subsequently, the hot melt coating is applied and allowed to cure. Finally, the top coat is applied thereby creating a roll of material that can be later cut into panels or other horizontal or vertical surfaces for installation as required.

Other embodiments and uses of the invention will be apparent to those skilled in the art from consideration of the specification and practice of the invention disclosed herein. All references cited herein, including all publications, U.S. and foreign patents and patent applications, are specifically and entirely incorporated by reference. It is intended that the specification and examples be considered exemplary only with the true scope and spirit of the invention indicated by the following claims. Furthermore, the term "comprising of" includes the terms "consisting of" and "consisting essentially of."

The invention claimed is:

1. A panel, comprising:

a fiberglass reinforced plastic (FRP) substrate;

an image affixed directly to the FRP substrate without any intermediary layers and covering the whole FRP substrate;

an abrasion resistant hot melt coating the substrate and image, wherein the abrasion resistant hot melt coating has a plurality of grooves embedded therein that correspond to the image; and a clear upper layer.

2. The panel of claim 1, further comprising a base layer affixed to the substrate, wherein the base layer is chosen from the group comprising fiberboard, particle board, cardboard, layers of paper, plastic, rubber, composite materials, fiberglass, sheet rock, honeycomb, nylon, wax or plastic impregnated materials, fused layers of materials, concrete, stone, metal, melamine, oriented strand board, and combinations thereof.

3. The panel of claim 1, wherein the image is affixed to the substrate by at least one of an ink jet printer, a laser printer, a solid ink printer, a dot matrix printer, a dye-sublimation printer, a thermal printer, a line printer, a gravure printer, and a plotter, and the image has a printed resolution of at least 250 dots per inch.

4. The panel of claim 3, wherein the image is chosen from the group comprising wood patterns, stone patterns, tile patterns, brick patterns, solid colors, natural patterns, unnatural patterns, pictures, or combinations thereof.

5. A system comprising a plurality of panels, wherein each panel is a panel of claim 4 and the pattern from a first panel continues onto a second panel.

6. The panel of claim 1, wherein the top coat of the panel is anti-slip and at least one of dent resistant, ultra violet light resistant, scratch resistant, and water damage resistant.

7. A system comprising a plurality of panels, wherein each panel is a panel of claim 1, and the panels are arranged to provide a temporary flooring.

8. The panel of claim 1, further comprising texture applied to the panel.

9. The panel of claim 1, wherein the panel is one of a horizontal or vertical surface.

10. The panel of claim 1, wherein the hot melt is a moisture curing hot melt.

11. The panel of claim 1, wherein the top coat is a UV (ultraviolet) curing top coat.

12. A system comprising a plurality of panels, wherein each panel is a panel of claim 1, the image on each panel is a portion of a larger image, and the larger image is adapted to continue, uninterrupted, from one panel to another panel.

13. The system of claim 12, wherein the larger image is adapted to continue, uninterrupted, from one panel to another panel regardless of orientation of the panels.

14. The system of claim 12, wherein each of the panels comprise the same image.

15. The system of claim 13, wherein each of the panels comprise the same image.

* * * * *